US009057296B2

(12) United States Patent
Hiramatsu et al.

(10) Patent No.: US 9,057,296 B2
(45) Date of Patent: Jun. 16, 2015

(54) MUFFLER

(71) Applicants: Mitsuru Hiramatsu, Toyota (JP); Wataru Mizutani, Miyoshi (JP)

(72) Inventors: Mitsuru Hiramatsu, Toyota (JP); Wataru Mizutani, Miyoshi (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/346,837

(22) PCT Filed: Sep. 17, 2012

(86) PCT No.: PCT/IB2012/001971

§ 371 (c)(1),
(2) Date: Mar. 24, 2014

(87) PCT Pub. No.: WO2013/046018

PCT Pub. Date: Apr. 4, 2013

(65) Prior Publication Data

US 2014/0231167 A1 Aug. 21, 2014

(30) Foreign Application Priority Data

Sep. 27, 2011 (JP) ..... 2011-211194

(51) Int. Cl.

| | |
|---|---|
| ***F01N 1/02*** | (2006.01) |
| ***F01N 1/00*** | (2006.01) |
| ***F01N 13/14*** | (2010.01) |
| ***F01N 13/18*** | (2010.01) |

(52) U.S. Cl.

CPC ..... *F01N 1/00* (2013.01); *F01N 13/141* (2013.01); *F01N 13/185* (2013.01)

(58) Field of Classification Search

CPC ..... F01N 1/02
USPC ..... 181/282
See application file for complete search history.

(56) References Cited

U.S. PATENT DOCUMENTS

| | | | | | |
|---|---|---|---|---|---|
| 2,834,427 | A * | 5/1958 | Powers et al. | 181/243 |
| 4,333,545 | A * | 6/1982 | Roberts | 181/282 |
| 4,842,096 | A * | 6/1989 | Fujitsubo | 181/252 |
| 5,080,379 | A * | 1/1992 | Zimmermann et al. | 277/640 |
| 5,422,445 | A * | 6/1995 | Baird et al. | 181/282 |
| 6,405,827 | B1 * | 6/2002 | Church | 181/243 |
| 7,293,628 | B2 * | 11/2007 | Takahashi | 181/227 |
| 7,364,013 | B2 * | 4/2008 | Nitta et al. | 181/282 |
| 7,591,345 | B1 * | 9/2009 | Goplen et al. | 181/272 |
| 7,740,105 | B2 * | 6/2010 | Kimata | 181/227 |
| 8,490,745 | B2 * | 7/2013 | Wirth et al. | 181/228 |
| 2005/0252713 | A1 * | 11/2005 | Takahashi | 181/227 |

FOREIGN PATENT DOCUMENTS

| | | | |
|---|---|---|---|
| JP | 04-021719 | U | 2/1992 |
| JP | 2002-206422 | A | 7/2002 |
| JP | 2004-293538 | A | 10/2004 |

* cited by examiner

*Primary Examiner* — Forrest M Phillips
(74) *Attorney, Agent, or Firm* — Sughrue Mion, PLLC

(57) ABSTRACT

A muffler having a shell of a double-layer structure includes an inner shell that is formed by fixing ends of a tubularly rolled plate material to each other through a lock seam, and an outer shell that is formed substantially in the same manner as the inner shell. In this muffler, a through-hole is provided through the inner shell at a position where the inner shell overlaps with a lock seam portion of the outer shell.

3 Claims, 3 Drawing Sheets

MUFFLER

BACKGROUND OF THE INVENTION

1. Field of the Invention

The invention relates to a muffler having a shell of a double-layer structure that has an inner shell that is formed by fixing ends of a tubularly rolled plate material to each other through a lock seam, and an outer shell that is formed substantially in the same manner as the inner shell.

2. Description of Related Art

As a muffler mounted on a vehicle or the like, there is a muffler of a double-roll lock seam structure. A shell of this muffler has a double-layer structure that has an inner shell as an inner layer, and an outer shell as an outer layer. Besides, a plate material is tubularly rolled, and ends of the plate material are fixed to each other through a lock seam to form each of the inner shell and the outer shell.

In this muffler, the water accumulated therein may enter a gap between the inner shell and the outer shell. Then, the water is heated by the heat of exhaust gas to be gasified. As a result, the pressure in the gap between the inner shell and the outer shell may rise to deform both the shells.

In view of this background, conventionally, there is known an art described in Japanese Patent Application Publication No. 2004-293538 (JP-2004-293538 A) in order to prevent such deformation of the shells. In Japanese Patent Application Publication No. 2004-293538 (JP-2004-293538 A), there is described a muffler having a structure as shown in FIG. 4. In this structure, a notch 52 is formed in an outer shell 53 at a position where the outer shell 53 overlaps with a lock seam portion 51 of an inner shell 50, and a gap between the inner shell 50 and the outer shell 53 communicates with the exterior of the muffler. Besides, in Japanese Patent Application Publication No. 2004-293538 (JP-2004-293538 A), there is also described a muffler having a structure as shown in FIG. 5. In this structure, a notch 54 is formed in the lock seam portion 51 of the inner shell 50, and the gap between the inner shell 50 and the outer shell 53 communicates with the interior of the muffler.

In each of these conventional mufflers, the pressure in the gap between the shells, which has risen due to the gasification of the water that has entered the muffler, is released from the notch 52 or 54. Thus, the pressure in the gap can be restrained from rising, and the shells can be prevented from being deformed.

However, in the case where the notch 54 is formed in the lock seam portion 51 of the inner shell 50, when a hole is formed through a region around the lock seam portion 51 of the outer shell 53 due to corrosion or a nick, the interior of the muffler and the exterior of the muffler immediately communicate with each other simply because of the formation of the hole.

Besides, in the case where the notch 52 is formed in the outer shell 53 as well, the region of the notch 52 is just as thick as a sheet of the plate material constituting the inner shell 50. Therefore, the interior of the muffler and the exterior of the muffler easily communicate with each other due to corrosion or a nick. Furthermore, since the gap between the inner shell 50 and the outer shell 53 is open to the outside, it is also feared that the water containing salt contents such as snow melting salt and the like may enter the gap from the outside to promote corrosion.

SUMMARY OF THE INVENTION

The invention provides a muffler that further restrains shells from being deformed due to a rise in the pressure in a gap between the shells.

A muffler having a shell of a double-layer structure in accordance with an aspect of the invention includes an inner shell formed by fixing ends of a tubularly rolled plate material to each other through a lock seam, and an outer shell formed substantially in the same manner as the inner shell. In this muffler, a through-hole is provided through the inner shell at a position where the inner shell overlaps with a lock seam portion of the outer shell. A diameter of the through-hole in a width direction of the lock seam portion may be smaller than a width of the lock seam portion.

In the aforementioned construction, even in the event of a rise in the pressure in a gap between the inner shell and the outer shell, the pressure is released through the through-hole that is provided through the inner shell at the position where the inner shell overlaps with the lock seam portion of the outer shell. Thus, the shells can be restrained from being deformed due to a rise in the pressure in the gap between the shells.

In addition, an upper portion (an external side) of the through-hole is completely covered with the lock seam portion of the thick outer shell, which is formed of a plurality of overlapping regions of the plate material. Thus, the interior of the muffler and the exterior of the muffler do not communicate with each other in the event of a slight nick or slight corrosion. Besides, the gap between the shells communicates with the interior of the muffler through the through-hole. Therefore, brine or the like does not enter the gap between the shells from the outside either.

Consequently, according to the aforementioned construction, the shells can be more suitably restrained from being deformed due to a rise in the pressure in the gap between the shells. Incidentally, condensed water may be accumulated inside the muffler. When a through-hole is provided through a bottom portion of the muffler, the region around the through-hole is constantly exposed to water, and is likely to corrode. Thus, the aforementioned through-hole may be provided at a position higher than the bottom portion of the muffler.

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

One embodiment as a concrete form of a muffler in accordance with the invention will be described in detail with reference to FIGS. 1 to 3. It should be noted herein that the structure of the muffler in accordance with this embodiment of the invention will be described first with reference to FIGS. 1 to 3.

Figure 1:
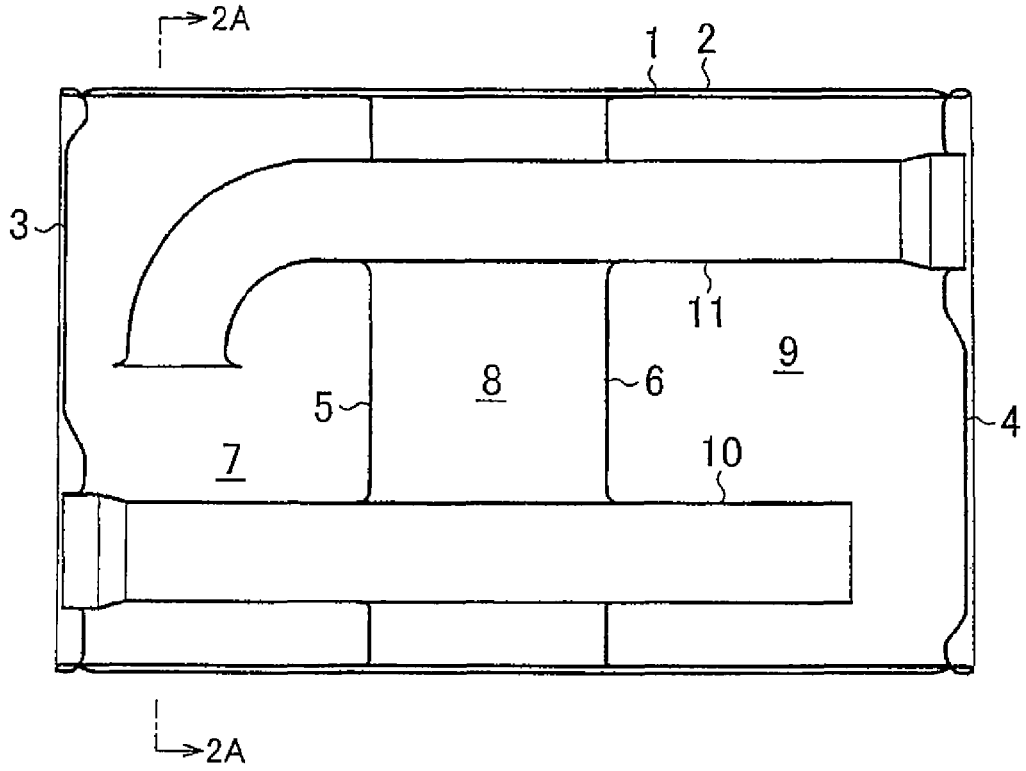
FIG. 1 is a cross-sectional view showing a plane section structure of one embodiment of a muffler in accordance with the invention.

As shown in FIG. 1, a of the muffler, which is formed generally in the shape of an elliptical tube, has a double-layer structure that has an inner shell 1 as an inner layer, and an outer shell 2 as an outer layer. A front panel 3 is fixed to the inner shell 1 and the outer shell 2 on a front end side of the muffler (on the left side in FIG. 1). Besides, a rear panel 4 is fixed to the inner shell 1 and the outer shell 2 on a rear end side of the muffler (on the right side in FIG. 1). These components form a shell of the muffler.

The interior of the muffler as described above is partitioned into three expansion chambers, namely, a first expansion chamber 9, a second expansion chamber 8, and a third expansion chamber 7 by two partition plates, namely, a first partition plate 5 and a second partition plate 6. Incidentally, a large number of holes are formed through each of the first partition plate 5 and the second partition plate 6. The respective expansion chambers (7 to 9) communicate with one another through the holes.

Besides, an inlet pipe 10 through which exhaust gas is introduced into the muffler, and an outlet pipe 11 through which exhaust gas is guided out of the muffler are disposed inside the muffler. The inlet pipe 10 is extended through the front panel 3, the first partition plate 5, and the second partition plate 6 from the front end side of the muffler, and has a front end that opens into the first expansion chamber 9. Besides, the outlet pipe 11 is extended through the rear panel 4, the second partition panel 6, and the first partition panel 5 from the rear end side of the muffler, and has a front end that opens into the third expansion chamber 7.

Next, the structure of the shell of this muffler will be described. As described above, the lateral periphery of this muffler has a double-layer structure that consists of the inner shell 1 and the outer shell 2. Each of the inner shell 1 and the outer shell 2 is formed by tubularly rolling a sheet of plate material made of stainless or the like, and fixing fitted ends thereof to each other through a lock seam, namely, superimposing the ends on each other and bending them.

Figure 2:
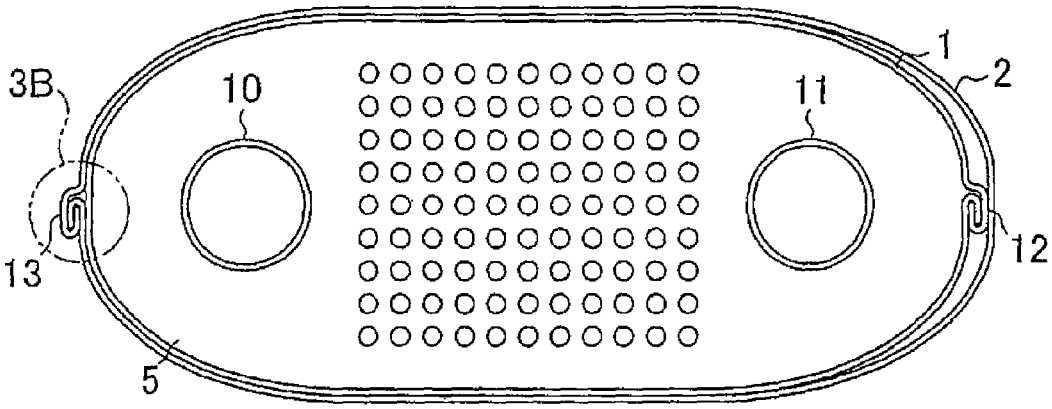
FIG. 2 is a cross-sectional view showing a frontal section structure of the muffler taken along a line 2A-2A of FIG. 1.

As shown in FIG. 2, in this muffler, a lock seam portion 12 of the inner shell 1 and a lock seam portion 13 of the outer shell 2 are so arranged as not to overlap with each other. In concrete terms, the lock seam portion 12 of the inner shell 1 is arranged on the right side of the muffler in FIG. 2, and the lock seam portion 13 of the outer shell 2 is arranged on the left side of the muffler in FIG. 2.

Figure 3:
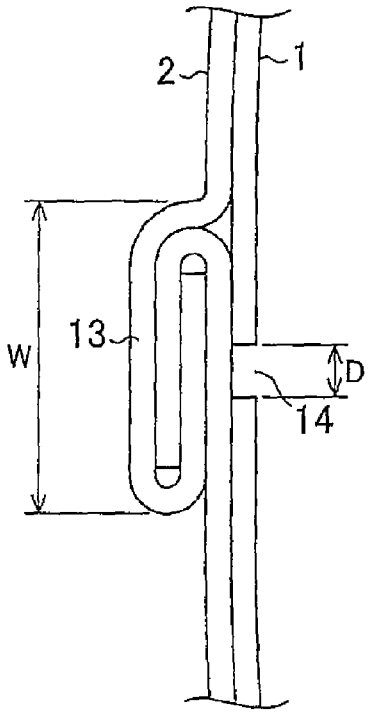
FIG. 3 is a cross-sectional view showing an enlarged section structure of a 3B region of FIG. 2.
Figure 4:
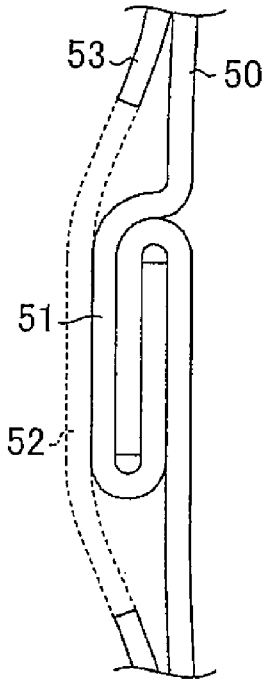
FIG. 4 RELATED ART
FIG. 4 is a cross-sectional view showing an enlarged section structure of a lock seam portion of an inner shell of a conventional muffler, and a periphery thereof.
Figure 5:
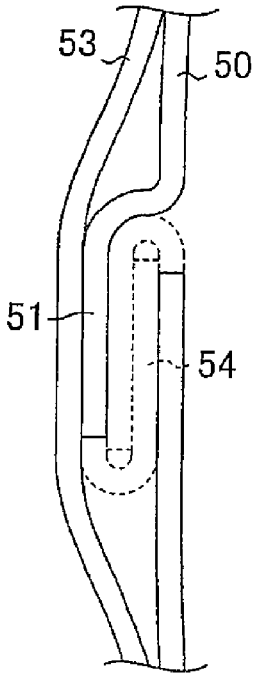
FIG. 5 RELATED ART
FIG. 5 is a cross-sectional view showing an enlarged section structure of a lock seam portion of an inner shell of another conventional muffler, and a periphery thereof.

On the other hand, as shown in FIG. 3, a through-hole 14 that penetrates the inner shell 1 is formed through this muffler. The through-hole 14 is formed through that region of the inner shell 1 which overlaps with the lock seam portion 13 of the outer shell 2. A diameter D of this through-hole 14 in a width W direction of the lock seam portion is smaller than the width W of the lock seam portion 13 of the outer shell 2. In this muffler, the through-hole 14 is formed as a circular hole. This through-hole 14 is drilled through punching at a stage prior to the rolling of the inner shell 1 into a generally elliptical tube.

Subsequently, the operation of the muffler constructed as described above will be described. In the muffler having the shell of this double-layer structure, the water contained in exhaust gas may enter a gap between the inner shell 1 and the outer shell 2 (which will be referred to hereinafter as "a gap between the shells"). Then, due to the gasification of the water by the heat of exhaust gas, the pressure in the gap between the shells may rise.

At this time, in the muffler in accordance with this embodiment of the invention, the pressure in the gap between the shells, which has thus risen, is released to the interior of the muffler through the through-hole 14. Thus, the pressure in the gap between the shells is restrained from excessively rising, so that the inner shell 1 and the outer shell 2 are restrained from being deformed due to the pressure.

Incidentally, in the muffler in accordance with this embodiment of the invention, an upper portion (an external side) of the through-hole 14 is completely covered with the lock seam portion 13 of the thick outer shell 2, which is formed of a plurality of overlapping regions of the plate material. Thus, even in the event of a slight nick or slight corrosion, the interior of the muffler and the exterior of the muffler do not communicate with each other. Besides, since the gap between the shells communicates with the interior of the muffler through the through-hole 14, brine or the like is also restrained from entering the gap between the shells from the outside.

According to the muffler in accordance with this embodiment of the invention described above, the following effects can be achieved.

(1) The pressure in the gap between the shells, which has risen due to the gasification of the water that has entered the gap, is released to the interior of the muffler through the through-hole 14. Therefore, the inner shell 1 and the outer shell 2 are restrained from being deformed due to the pressure.

(2) The upper portion (the external side) of the through-hole 14 is completely covered with the lock seam portion 13 of the outer shell 2, which is formed of the plurality of the overlapping regions of the plate material. Therefore, even in the event of a slight nick or slight corrosion, the interior of the muffler and the exterior of the muffler do not communicate with each other.

(3) No region of the shell of the muffler is formed only of a single plate material. Therefore, the strength of the shell is restrained from decreasing due to the formation of the through-hole 14. (4) The through-hole 14 is provided through the inner shell 1, and the gap between the shells does not communicate with the exterior of the muffler. Therefore, water containing salt contents such as snow melting salt and the like is restrained from entering the gap between the shells from the outside to promote corrosion.

(5) The through-hole 14 is provided through the lateral portion of the muffler. Therefore, the region around the through-hole 14 can be restrained from corroding due to the condensed water accumulated in the muffler. Incidentally, the foregoing embodiment of the invention can also be carried out after being modified as follows.

Although the lateral portion of the muffler is provided with the through-hole 14, namely, with the lock seam portion 13 of the outer shell 2 in the foregoing embodiment of the invention, the through-hole 14 or the lock seam portion 13 of the outer shell 2 may be provided at other positions. However, in the case where the through-hole 14 is provided through a bottom portion of the muffler, the through-hole 14 continues to be exposed to the condensed water accumulated inside the muffler, so that the corrosion of the region around the through-hole 14 is likely to progress. Thus, in the case where sufficient corrosion resistance of the plate material constituting the inner shell 1 cannot be ensured, the through-hole 14 may be provided at a position other than the bottom portion of the muffler (at a position higher than the bottom portion).

Although the through-hole 14 is formed before the inner shell 1 is rolled into a generally elliptical tube in the foregoing embodiment of the invention, it is also appropriate to form the through-hole 14 at other timings, for example, after the inner shell 1 is formed.

Although the through-hole 14 is drilled through punching in the foregoing embodiment of the invention, it is also appropriate to form the through-hole 14 according to other methods such as cutting and the like. Although the through-hole 14 is a circular hole in the foregoing embodiment of the invention, it is also appropriate to design the through-hole 14 as a hole having other shapes.

In the foregoing embodiment of the invention, only the single through-hole 14 is provided. However, if the single through-hole 14 alone cannot sufficiently restrain the pressure in the gap between the shells from rising, it is also appropriate to provide a plurality of through-holes 14 through the inner shell 1 in a region where the inner shell 1 overlaps with the lock seam portion 13 of the outer shell 2.

The invention can also be applied in a similar manner to a muffler whose contour or internal structure is different from that of the foregoing embodiment of the invention. In short, the invention is applicable to any muffler whose lateral periphery is formed of an inner shell that is formed by fixing fitted ends of a tubularly rolled plate material to each other through a lock seam, and an outer shell that is formed substantially in the same manner as the inner shell and arranged outside the inner shell.

The invention claimed is:

1. A muffler comprising:

a shell of a double-layer structure including an inner shell and an outer shell, the inner shell including a lock seam portion of the inner shell in which ends of a tubularly rolled plate material are fixed to each other, the outer shell including a lock seam portion of the outer shell in which ends of a tubularly rolled plate material are fixed to each other, and the inner shell including a through-hole at a position where the inner shell overlaps with the lock seam portion of the outer shell.

2. The muffler according to claim 1, wherein a diameter of the through-hole in a width direction of the lock seam portion of the outer shell is smaller than a width of the lock seam portion of the outer shell.

3. The muffler according to claim 1 or 2, wherein the through-hole is provided at a position higher than a bottom portion of the muffler.

* * * * *